United States Patent [19]

Currigan

[11] 4,080,228

[45] Mar. 21, 1978

[54] AGGREGATE PRODUCT AND METHOD OF APPLYING TO SURFACES

[76] Inventor: Edward B. Currigan, 3055 Alvarado Rd., San Leandro, Calif. 94577

[21] Appl. No.: 749,529

[22] Filed: Dec. 10, 1976

[51] Int. Cl.[2] ..... E04B 2/00

[52] U.S. Cl. ..... 156/71; 51/297; 52/746; 156/298; 156/309; 156/303.1; 156/330; 206/225; 404/82; 404/12; 404/15; 428/240; 428/247; 428/906

[58] Field of Search ..... 156/71, 309, 279, 324, 156/298, 330, 297, 303.1; 427/137, 204, 205; 52/746; 404/12, 82, 15; 428/67, 247, 148, 283, 149, 328, 240, 331, 241, 906, 242; 206/412, 225; 51/297, 298 R

[56] References Cited

U.S. PATENT DOCUMENTS

| | | | |
|---|---|---|---|
| 1,756,396 | 4/1930 | Spicer | 206/412 |
| 2,778,169 | 1/1957 | Ball | 51/297 |
| 2,798,822 | 7/1957 | Carter | 427/204 |
| 3,230,842 | 1/1966 | Denton et al. | 156/71 |
| 3,608,444 | 9/1971 | Levy et al. | 404/82 |
| 3,761,190 | 9/1973 | Thaning | 404/82 |
| 4,020,211 | 4/1977 | Eigenmann | 404/14 |

FOREIGN PATENT DOCUMENTS

| | | | |
|---|---|---|---|
| 2,403,398 | 9/1974 | Germany | 404/14 |

OTHER PUBLICATIONS

Rose (ed.), *Condensed Chemical Dictionary*, 7th Ed., pp. 41 & 844 © 1966.

*Primary Examiner*—William A. Powell
*Assistant Examiner*—J. J. Gallagher

[57] ABSTRACT

An aggregate product comprising an aggregate, such as alumina of a size from about ½ inch to about 60 mesh, is bonded in a substantially continuous layer by means of conventional adhesives to a strip of fine mesh, such as nylon mesh. A viscous adhesive, such as a two-component epoxy resin, applied to the surface to be covered, bonds the aggregate-containing mesh to such surface.

The method of this invention comprises coating a surface with a viscous adhesive, placing over such surface the aggregate-containing mesh, initiating pressure so as to cause settling of the aggregate-containing mesh into the viscous adhesive, and allowing the adhesive to bond the aggregate-containing mesh to the surface. Preferably, the adhesive is sprayed or rolled onto the surface and the aggregate-containing mesh is rolled out over the wet adhesive using a tape or string attached to the roll to propel it from a rolled-up position.

11 Claims, 3 Drawing Figures

AGGREGATE PRODUCT AND METHOD OF APPLYING TO SURFACES

BACKGROUND OF THE INVENTION

This invention relates to aggregate products and more particularly to the application of particulate or aggregate to surfaces such as road or wall surfaces.

In road building and maintenance, reflective stripes and roadmarkings must be applied in accordance with strict specifications as to hardness, abrasiveness, wear resistance, cure-time of resin used and the like. For example, the placing of reflectorized traffic stripes and markings requires specific thermoplastic compounds with pigments, glass spheres, and filler being well dispersed in the resin. Further requirements as to color retention, water absorption, etc., must be met. At present, traffic striping and road marking is accomplished by using a hot-melt process in which the road pavement is pre-heated prior to application of resinous material containing the pigment, filler, and other required additives. Special kettles and applicators must be provided for melting, heating, and applying the molten thermoplastic material. Hand applicator equipment must be insulated and have sufficient capacity and yet be sufficiently maneuverable to install cross walks, lane, edge, and center lines, as well as arrows and legends. Application time, weather limitations and surface preparation, as well as the use of sealing primer, must also be considered in order to insure an acceptable finished product.

While the hot-melt process has proven to be valuable in that the resinous composition cures almost instantly upon cooling, it has also been shown to be less than satisfactory for a number of reasons. An especially significant disadvantage has been the slipperiness of the finished product under any damp conditions. The addition of glass beads to the resinous material after its application to the road surface and prior to its curing, as in accordance with specifications, is not designed to remedy such situation, and there are at present no abrasive or non-skid additives which eliminate skidding in the finished product.

Moreover, the cost of the hot-melt process is extremely high. Raw material must be purchased in precast block form. Packaging in cartons is required to avoid sticking together of the raw material. In addition to the cost of raw material, considerable additional expenditures are required for applicator equipment as well as for equipment to pre-heat by open flame the road pavement ahead of the applicator equipment. And in addition to the slipperiness, the finished product has been found to fail in adhesiveness, to become embrittled under icy conditions, and to break up under the impact of snow plows.

In addition to the area of traffic striping and road marking, the application of aggregate or particulate to structural walls, floors, or the like, whether for decorative effect or for wearing purposes, has proven to be difficult or costly, or both. Too often, the methods of application of aggregate to such surfaces requires time-consuming operations, such as with a terrazzo tile application, with the result that labor costs are prohibitive. That is, there has not been available any low-cost and readily usable method for applying any of a wide range of aggregates to surfaces.

SUMMARY OF THE INVENTION

In accordance with this invention, there is provided a mesh having aggregate bonded thereon in a substantially continuous layer, together with a viscous adhesive to be applied to the surface and against which the aggregate-containing mesh is placed, such that the mesh will settle into the adhesive and be bonded to the surface. The mesh can be a strip of plastic or metal having a width from less than ¼ inch up to 72 inches or more. Preferably, the aggregate is alumina having a particulate size of from about 60 mesh up to about ½ inch.

It is especially preferred that a two-component epoxy resin be employed as the viscous adhesive to be used with a mesh containing alumina as the aggregate. The combination of alumina aggregate together with epoxy adhesive has proven to be especially valuable in traffic striping and road marking, as well as in similar applications, to provide a finished product having the highest qualities of hardness, abrasiveness, and adhesiveness.

The method of this invention comprises coating the surface with a viscous adhesive, placing over such surface the aggregate-containing mesh, applying an initial pressure to allow settling of the aggregate-containing mesh into the viscous adhesive, and allowing the adhesive to bond the aggregate-containing mesh to the surface.

It is therefore a primary object of this invention to provide a method and product for inexpensively applying aggregate to a surface without the need for heat.

It is another object of this invention to provide an aggregate-containing mesh in roll form such that the mesh need only be rolled out over the surface to which the aggregate is to be adhered.

It is a further object of this invention to provide a method and product for applying aggregate to road pavement for the purpose of bonding thereto a removable traffic stripe or similar road marking without the need for heat application.

It is a still further object of this invention to provide a traffic stripe or similar road marking of high reflective value and superior wear resistance, as well as one capable of producing a warning signal when driven over.

It is a still further object of this invention to provide a non-skid traffic stripe and road marking.

It is a yet further object of this invention to provide a method and product for applying aggregate to a surface for decorative purposes.

These and other objects of the invention will become apparent to those skilled in the art from the reading of the description of the preferred embodiment, as well as from examining the following described drawings.

BRIEF DESCRIPTIONS OF THE DRAWINGS

DESCRIPTION OF THE PREFERRED EMBODIMENT

Figure 1:
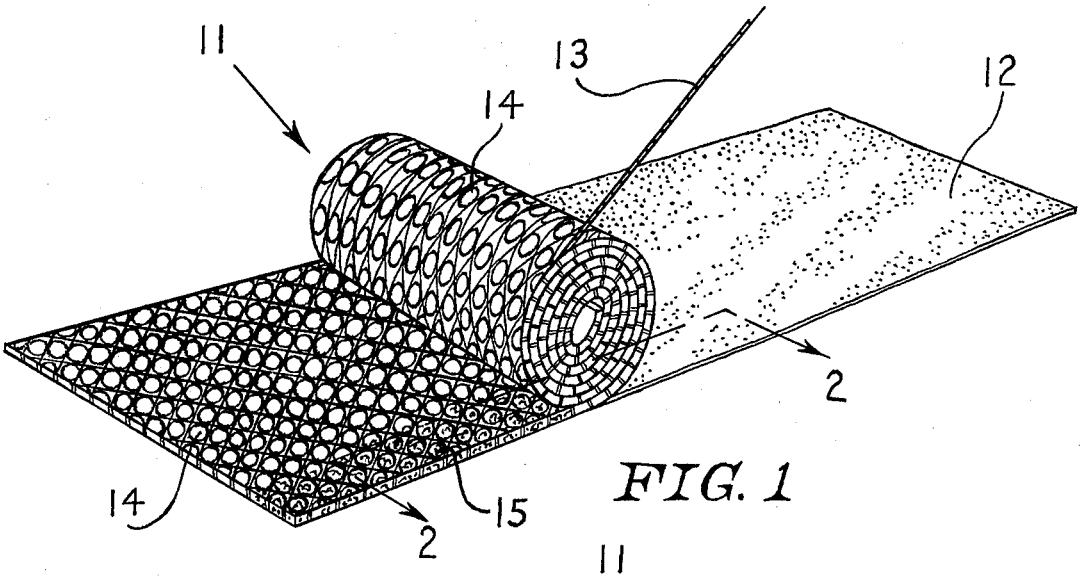
FIG. 1 is a perspective view of a roll of aggregate-containing mesh in the process of being rolled out over a layer of viscous adhesive.

Referring to FIG. 1, a roll 11 of aggregate-containing mesh is rolled out over a layer of viscous adhesive 12, to form a traffic stripe as in accordance with one of the preferred applications of this invention. Rolling out of roll 11 can be accomplished by using a narrow tape or string 13. When ready to unroll the roll, a person need only grasp the tape or string and propel the roll from a standing position.

The mesh 14 can be formed of a continuous strip of plastic, metal or the like, and in various widths. Preferably, the strip is formed of nylon mesh and has a width of from about ¼ inch up to 72 inches. Also, depending upon the size of the aggregate and the specific application thereof, the mesh can have a size of from about ½ inch down to 60 mesh.

Figure 2:
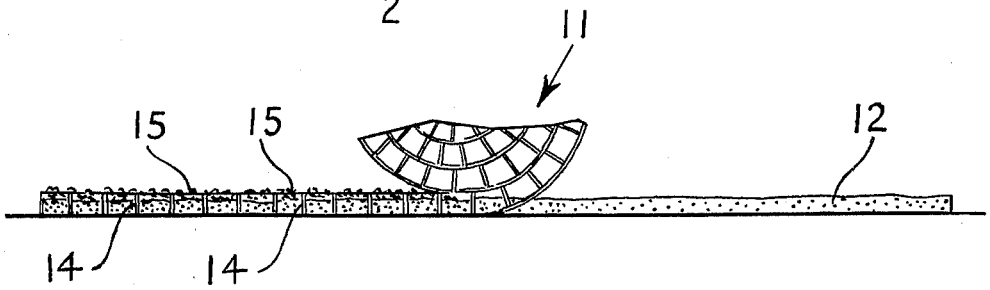
FIG. 2 is a sectional view taken along line 2—2 of FIG. 1.

As shown in FIG. 2, an aggregate 15 is bonded to one side of the mesh 14 by means of any conventional adhesive, the aggregate thus forming a substantially continuous upper layer when the mesh is laid out over the viscous adhesive 12. Alumina is a preferred aggregate for use in the present invention, especially for use in traffic striping and road marking. That is, it has been discovered that the angular surface characteristics of alumina, when applied to a road surface as in accordance with this invention, result in a non-skid traffic stripe or roadmarking. By contrast, conventional resinous materials used in the present hot-melt process are laid out as a flat sheet while hot, and result in a finished surface completely lacking in abrasiveness.

Another aggregate is silicon carbide, which is preferably used in combination with alumina to provide traffic striping and road markings of high reflective value. In fact, silicon carbide provides such a high degree of reflectiveness that there is no need for the application of glass beads, as in the conventional hot-melt process. However, glass beads as commonly required in state highway specifications can be combined with the aggregate prior to bonding thereof to the mesh. Moreover, there is no need for post application of glass beads as is required with the conventional hot-melt process.

In areas other than traffic striping and road marking, a variety of other types of aggregate can be bonded to the mesh in forming the product of this invention. For example, fragments of granite and small rocks can be utilized. Sandblasting sand, such as that commonly used in aquarium bottoms, can be bonded to a fine mesh for decorative application. In short, any type of aggregate or particulate matter can be employed for application in a substantially continuous layer to a wide variety of surfaces.

The viscous adhesive 12 is preferably a two component, 100 percent solids epoxy resin which is applied to the road pavement or other substrate by brush, roller, or spray. A primer is not required; the epoxy resin can be applied to wet pavement. The combination of an epoxy resin as a viscous adhesive with alumina as the aggregate provides an extremely hard traffic stripe and one having superior adhesion to the road surface. In addition to not requiring a primer, the epoxy resin can be applied in any kind of weather, and the alumina aggregate not only has a hardness comparable to that of diamonds, but also exhibits a high brightness value.

The viscous adhesive 12, such as the epoxy resin described, is laid out on the road surface in a depth depending on the diameter size of the aggregate contained on the mesh. To achieve a greater depth of adhesive, it is only necessary to increase the viscosity of the viscous adhesive 12, which is easily accomplished by means of extenders. A very fine non-skid aggregate would require only a thin, fast-flowing viscous adhesive. In traffic striping it is a common requirement that the finished stripe be approximately ⅛ inch thick. Accordingly, an 8 mesh size aggregate-containing mesh would be employed. A particularly useful epoxy resin would be a two-component epoxy resin having a pot life of about 20 minutes and a full cure time of about 3 hours. Following application, such a traffic stripe would bear traffic in about 20 minutes.

Application of the traffic stripe is accomplished by first brushing, rolling, or spraying the viscous adhesive on the road surface. Immediately thereafter, the roll of aggregate-containing mesh is rolled over the viscous adhesive and allowed to subside. As noted, the viscosity of the adhesive can be adjusted so as to allow for settling of the adhesive layer with the upper portions of the aggregate particles being exposed above the adhesive. That is, the very tips of the aggregate will protrude from the surface, to provide the wearing area of the traffic stripes.

The finished traffic stripe will not only exhibit superior hardness and the highest of reflective values, but will also produce an audible signal when driven over to serve as a warning to drivers. Additionally, the combination of alumina aggregate and epoxy adhesive will provide a traffic stripe having superior resistance to freeze/fog conditions of winter areas, and will be extremely resistance to de-icing salts and chemicals. Due to the extreme hardness of the alumina, together with such superior adhesion, the resulting traffic stripe will not be subject to destruction by snow plows.

Figure 3:
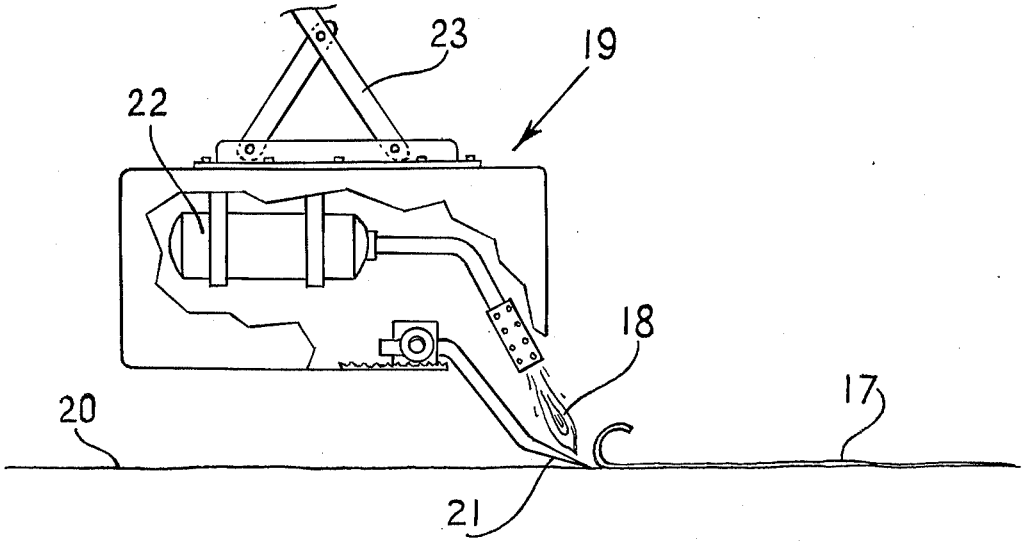
FIG. 3 is a side elevational view, partly broken away, illustrating removal of a traffic stripe.

A further significant advantage of the traffic stripes produced in accordance with this invention is that they can be removed, as shown in FIG. 3. Finished traffic stripe 17 is simultaneously heated by flame 18 of removal unit 19 and separated from the road surface 20 by blade 21. Conventional heating units consisting of burners 22 can be supported by carrying arm 23 or the like according to standard thermal practices. Thus, traffic patterns can be readily changed by simply removing the traffic stripes. Such can not presently be done with the conventional hot-melt application.

The aggregate-containing mesh can be inexpensively manufactured using a production line in which adhesive is applied to a roll of mesh as it is propelled along. Hoppers are provided above the mesh for dispensing aggregate, glass beads, and the like, for bonding of such materials to the mesh. The aggregate-containing mesh then goes through a dryer and is rerolled.

In accordance with the method of this invention, the surface is first coated with a viscous adhesive as described above, the aggregate-containing mesh is rolled or otherwise placed over such coated surface such that it settles into the viscous adhesive, and finally the viscous adhesive is allowed to bond the aggregate-containing mesh to the surface. When the aggregate-containing mesh is to be applied to a horizontal surface, as in the case of traffic striping, settling will be accomplished by gravity. With nonhorizontal surfaces, slight initial pressure will be sufficient to cause the aggregate-containing mesh to settle into the viscous adhesive. Again, the use of extenders to control viscosity will allow the ready bonding of the aggregate-containing mesh to vertical or slanted surfaces.

Although only one specific embodiment of the aggregate-containing product of this invention has been described, it is clear that modifications of the invention can be made by those skilled in the art without departing from the spirit thereof, as set forth in the following claims.

What is claimed is:

1. A method of applying aggregate to a surface comprising;

a. coating the surface with a viscous adhesive;

b. placing over such surface a mesh having aggregate bonded in a substantially continuous layer to its upper side;

c. settling the aggregate-containing mesh into the viscous adhesive such that the top portions of the aggregate will protrude from the surface; and d. allowing the adhesive to bond the aggregate-containing mesh to the surface.

2. The method of claim 1 to wherein the aggregate-containing mesh comprises a role of nylon mesh of about 8 mesh size and having a width of from about ¼ inch to 72 inches, and wherein the roll is unrolled over a horizontal surface, such as a road, which has been coated with viscous adhesive, such that the aggregate-containing mesh will settle by gravity into the viscous adhesive and be quickly bonded thereby to the horizontal surface.

3. The method of claim 1 wherein the viscous adhesive is applied by spraying, rolling or brushing.

4. The method of claim 1 wherein the aggregate-containing mesh is applied to a non-horizontal surface.

5. An aggregate product for application to a surface without the need for heat comprising;

a. a mesh;

b. an aggregate bonded in a substantially continuous layer to the upper side of the mesh; and c. a viscous adhesive adapted for initial application to the surface and to receive the lower side of the aggregate-containing mesh, the viscosity of the adhesive being adjusted such that the mesh will settle into the adhesive and bond to the surface with the upper portions of the aggregate being exposed above the adhesive.

6. The aggregate product of claim 1 wherein the mesh is formed of a strip of plastic having a width from about ¼ inch to 72 inches and which is capable of being rolled up after bonding of the aggregate to the mesh.

7. The aggregate product of claim 6 wherein the mesh has a size of from about ½ inch to 60 mesh.

8. The aggregate product of claim 1 wherein the aggregate is alumina.

9. The aggregate product of claim 1 wherein the aggregate comprises a combination of alumina and silicon carbide.

10. The aggregate product of claim 1 wherein the viscous adhesive is a two-component 100 percent solids epoxy resin capable of being applied to a surface by brush, sprayer, roller or the like.

11. The aggregate product of claim 1 for use in traffic striping wherein the mesh comprises a nylon strip of about 8 mesh size, the aggregate comprises tabular alumina having a screen size of about 8 to 20 mesh, and the viscous adhesive comprises a two-component epoxy resin having a pot life of about 20 minutes and a cure time of about 3 hours.

* * * * *